US007704083B1

(12) United States Patent
Cheyne et al.

(10) Patent No.: US 7,704,083 B1
(45) Date of Patent: Apr. 27, 2010

(54) BUSBAR CONNECTOR

(75) Inventors: Scott R. Cheyne, Brookline, NH (US); Jeffrey Paquette, Newton, MA (US); John D. Walker, Bolton, MA (US); Dimitry Zarkh, Waltham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/409,639

(22) Filed: Mar. 24, 2009

(51) Int. Cl.
*H01R 4/60* (2006.01)

(52) U.S. Cl. ..... 439/115; 439/213

(58) Field of Classification Search ..... 439/110–115, 439/212–213
See application file for complete search history.

(56) References Cited

U.S. PATENT DOCUMENTS 6,480,167 B2 11/2002 Matthews
6,530,791 B1 * 3/2003 Hierzer ..... 439/115
6,624,787 B2 * 9/2003 Puzella et al. ..... 343/700 MS
7,348,932 B1 * 3/2008 Puzella et al. ..... 343/853
7,425,140 B2 * 9/2008 Lehman et al. ..... 439/115

* cited by examiner

*Primary Examiner*—Khiem Nguyen
(74) *Attorney, Agent, or Firm*—Daly, Crowley, Mofford & Durkee, LLP

(57) ABSTRACT

In one aspect, a busbar connector includes first and second portions. Each portion includes a rigid member forming an exterior portion of the busbar connector, a conduction member forming an interior portion of the busbar connector and a compliant member having a stiffness less than the rigid member and including a first surface attached to the rigid member and a second surface opposite the first surface attached to the conduction member. The busbar connector also includes a fastener structure configured to secure a first busbar and a second busbar between and in contact with the conduction members of the first and second portions to allow current to flow between the first and second busbars.

18 Claims, 12 Drawing Sheets

14
14
14
14
10
12
12'
12
12
12

BUSBAR CONNECTOR

BACKGROUND

Busbars refer to thick strips of metal (e.g., copper or aluminum) that conduct electricity within an electrical system often carrying high current or requiring low inductance. Sometimes busbars from two separate electrical systems need to be connected to transfer electricity between the two electrical systems. The most common method for attaching busbars together has been to use fasteners. Another approach to attach busbars together is to use a sliding-style connector that pushes on the adjoining two busbars from the side. The sliding-style connector relies on a louvered interface to ensure adequate electrical contact and mechanical retention.

SUMMARY

In one aspect, a busbar connector includes first and second portions. Each portion includes a rigid member forming an exterior portion of the busbar connector, a conduction member forming an interior portion of the busbar connector and a compliant member having a stiffness less than the rigid member and including a first surface attached to the rigid member and a second surface opposite the first surface attached to the conduction member. The busbar connector also includes a fastener structure configured to secure a first busbar and a second busbar between and in contact with the conduction members of the first and second portions to allow current to flow between the first and second busbars.

In another aspect, a busbar connector includes first and second portions. Each portion includes first and second rigid members forming an exterior portion of the busbar connector, a conduction member forming an interior portion of the busbar connector and a compliant member having a stiffness less than the first and a second rigid members and including a first surface attached to the first and a second rigid members and a second surface opposite the first surface attached to the conduction member. The busbar connector also includes a first fastener structure and a second fastener structure configured to secure a first busbar and a second busbar between and in contact with the conduction members of the first and second portions to allow current to flow between the first and second busbars by applying a force from the exterior portion of the busbar connector to the interior portion of the busbar connector on each of the first and second rigid members substantially in centers of the first and a second rigid members.

In a further aspect, a system includes a line replaceable unit including panels configured to provide radio frequency signals and a first busbar in electrical connection with the panels. The system also includes a busbar connector and a supply bus including a second busbar. The busbar connector includes first and second portions. Each portion includes first and second rigid members forming an exterior portion of the busbar connector, a conduction member forming an interior portion of the busbar connector and a compliant member having a stiffness less than the first and second rigid members and comprising a first surface attached to the first and second rigid members and a second surface opposite the first surface attached to the conduction member. The busbar connector also includes a first fastener structure and a second fastener structure configured to secure a first busbar and a second busbar between and in contact with the conduction members of the first and second portions to allow current to flow between the first and second busbars by applying a force from the exterior portion of the busbar connector to the interior portion of the busbar connector on each of the first and second rigid members substantially in center portions of the first and a second rigid members.

In a still further aspect, a method to connect a first busbar and a second busbar, includes providing a first portion and a second portion. Each portion includes a rigid member forming an exterior portion of the busbar connector, a conduction member forming an interior portion of the busbar connector; and a compliant member having a stiffness less than the rigid member and including a first surface attached to the rigid member and a second surface opposite the first surface attached to the conduction member. The method further includes using a fastener structure to secure the first busbar and the second busbar between and in contact with the conduction members of the first and second portions to allow current to flow between the first and second busbars.

DETAILED DESCRIPTION

As described herein, a busbar connector (e.g., a busbar connector 20) solves a problem of interconnecting two high-current busbars while minimizing inductance and voltage drop. In addition, the busbar connector can compensate for misalignment and non-coplanarity between busbars due to assembly and manufacturing tolerances. Also, the busbar connector allows for a zero-insertion force and provides a smooth electrical contact region to eliminate damage to the busbars and eliminates foreign object debris. The busbar connector includes a captive feature to ensure that a busbar connector remains with a busbar when disengaged from an electrical connection. Also, a process of connecting and disconnecting busbars to the busbar connector is quick and repeatable.

While the embodiments of the busbar connector described herein are used in a panel array system environment, the busbar connector may be used in any environment that connects two busbars together.

Figure 1:
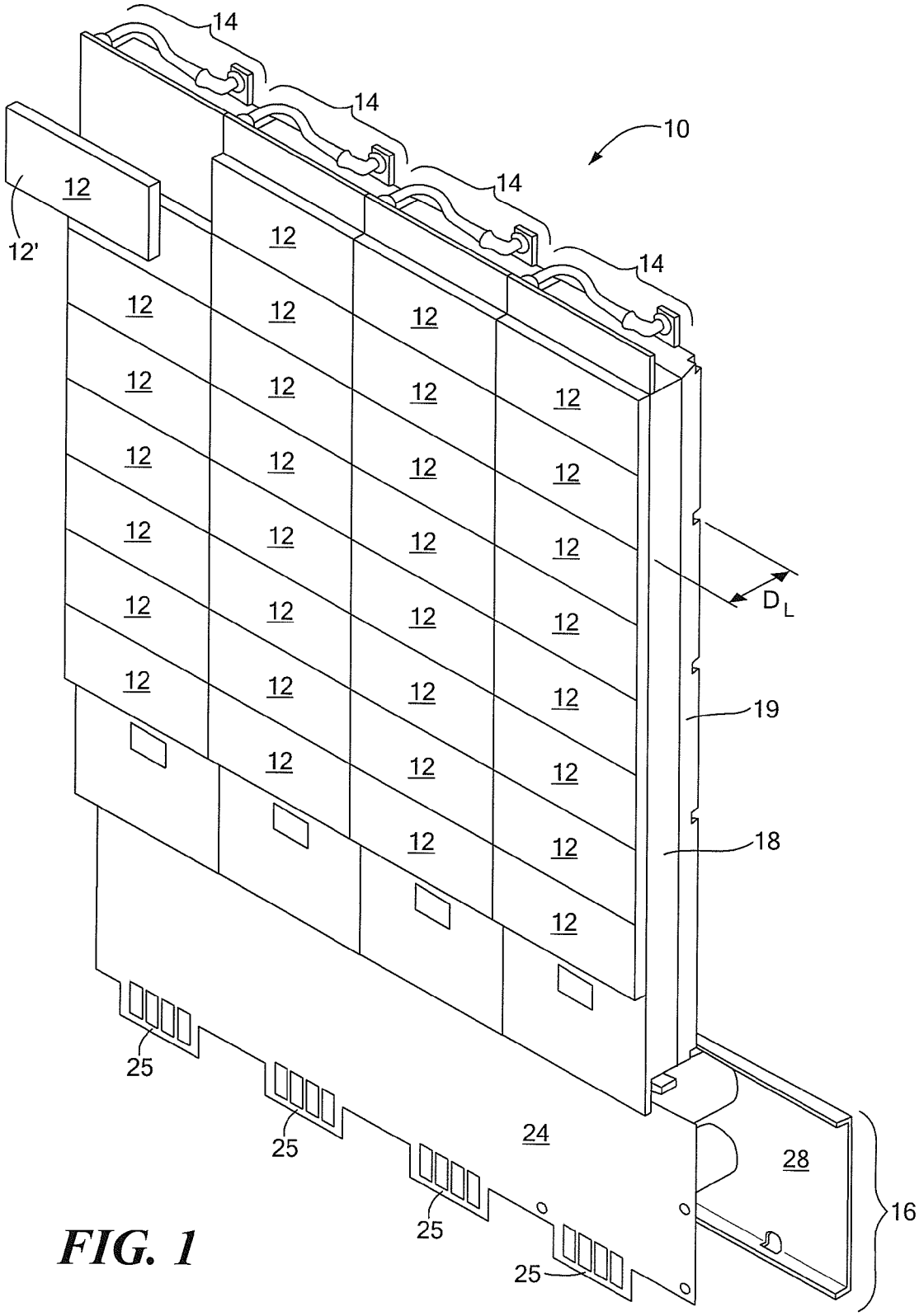
FIG. 1 is a front view of diagram of a panel array.
Figure 2:
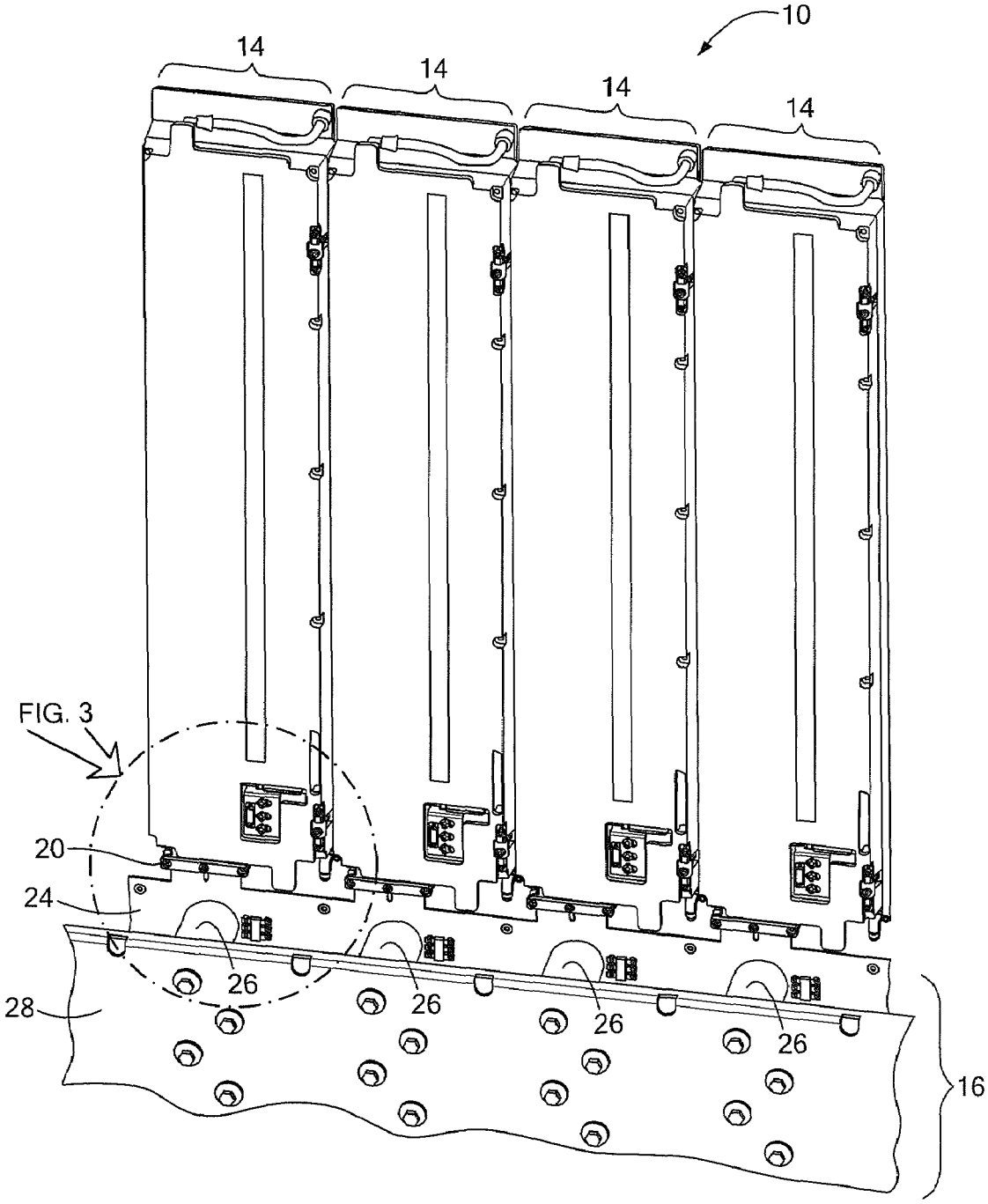
FIG. 2 is a back view of the panel array system of FIG. 1.
Figure 3:
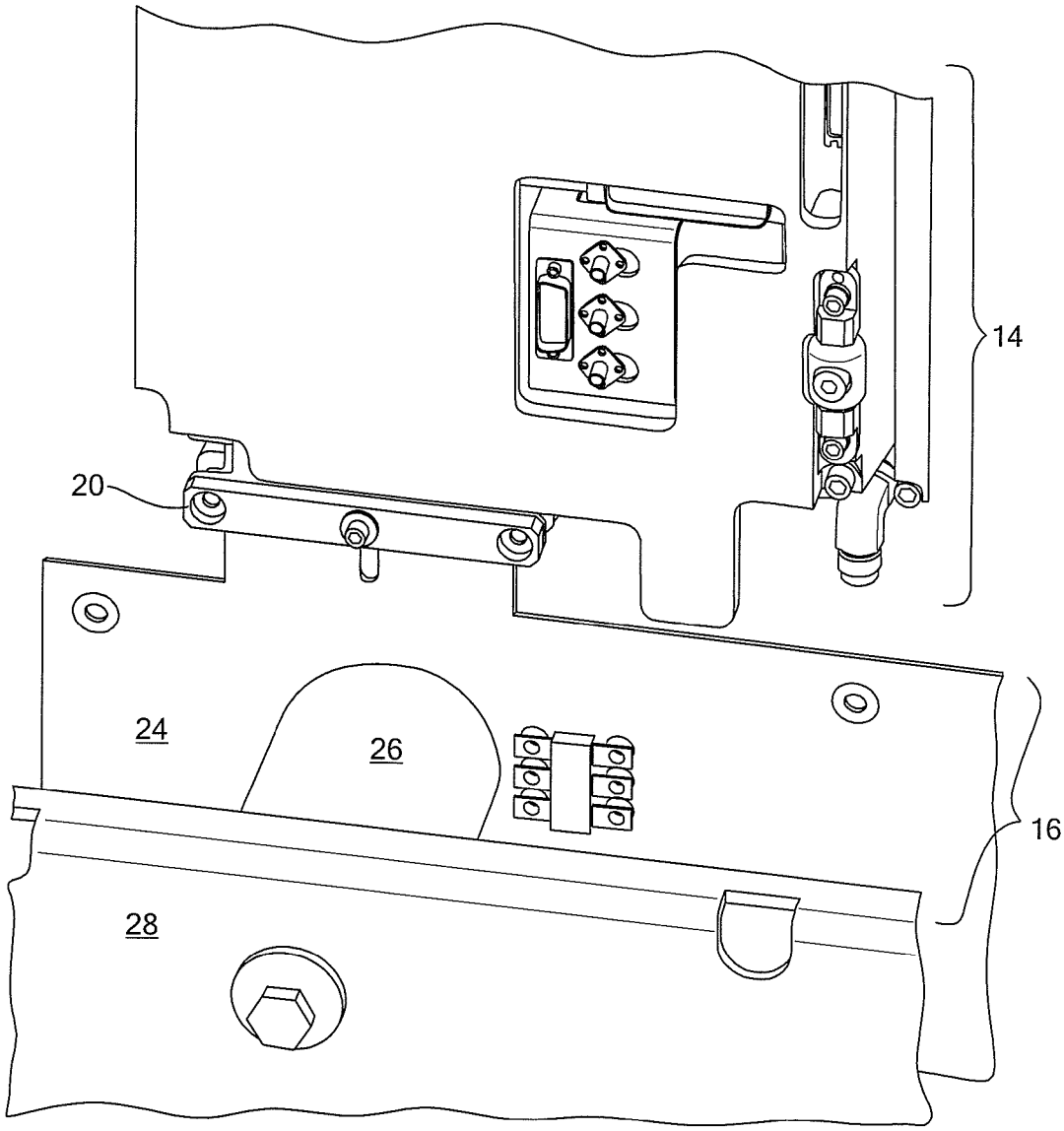
FIG. 3 is another back view of the panel array system of FIG. 2.

Referring to FIGS. 1 to 3, a panel array system 10 includes line replaceable units (LRUs) 14. The LRUs 14 include panels 12 that are removably attached to the LRUs. For example, panel 12' is shown detached (e.g., in an exploded view) from the LRU 14. The LRUs 14 also include a heat sink 18 (e.g., a liquid cooling system) to cool the panels 12 and a rear heat sink 19 to cool electronics (not shown).

The panel array system 10 also includes a main distribution bus 16 that provides DC power to the LRUs 14 from a DC power source 19 (FIG. 4) to power the panels 12. The main distribution bus 16 includes a supply bus 24 that includes a bank of capacitors 26, and a support structure 28. The supply bus 24 includes connectors 25 that connect to and receive power from an external source (not shown). The capacitors 26 (e.g., 0.1 F capacitors) supply DC power through the busbar connector 20 to the LRUs 14.

The panels 12 are radio frequency (RF) panels that provide and receive RF signals and are used, for example, in radar or communications. In one example, the panel array system 10 includes four LRUs 14 and a single LRU 14 includes eight panels 12 for a total of thirty-two panels in the panel array system.

In one example, the panel array system 10 is a phased array system. The relatively high cost of phased arrays has precluded the use of phased arrays in all but the most specialized applications. Assembly and component costs, particularly for active transmit/receive channels, are major cost drivers. Phased array costs can be reduced by utilizing batch processing and minimizing touch labor of components and assemblies. Therefore, it is advantageous to provide a tile sub-array (e.g., the panel 12), for an Active, Electronically Scanned Array (AESA) that is compact, which can be manufactured in a cost-effective manner, that can be assembled using an automated process, and that can be individually tested prior to assembly into the AESA. By using a tile sub-array (e.g., a panel) configuration, acquisition and life cycle costs of phased arrays are lowered, while at the same time improving bandwidth, polarization diversity and robust RF performance characteristics to meet increasingly more challenging antenna performance requirements.

In one example, the panel array system 10 enables a cost-effective phased array solution for a wide variety of phased array radar missions or communication missions for ground, sea and airborne platforms. In at least one example, the panel array system 10 provides a thin, lightweight construction that can also be applied to arrays attached to an aircraft wing or a fuselage or a sea vessel or an Unmanned Aerial Vehicle (UAV) or a land vehicle. In one example, a depth, $D_L$, of the LRU 14 is about 4.5 inches, for example. The array of panels 12 is relatively very thin which provides greater flexibility in where the panel array system 10 can be used and the overall size of the array of panels is significantly less than prior approaches.

Other phased arrays and phased array configurations may be found in U.S. Pat. No. 7,348,932 and U.S. Pat. No. 6,624,787, which are incorporated herein in their entirety and are assigned to the same assignee (Raytheon Company of Waltham, Mass.) as the present patent application.

Figure 4:
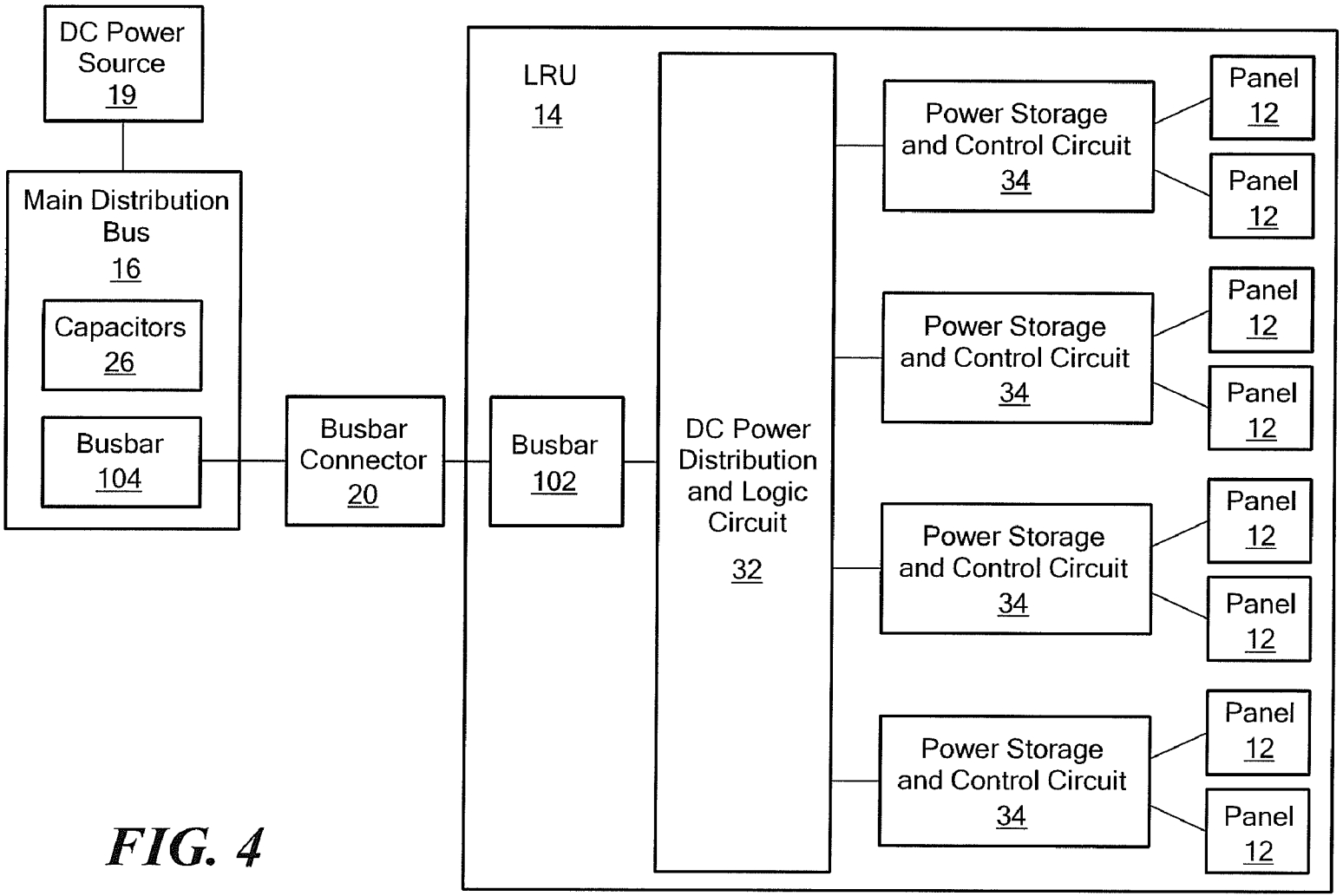
FIG. 4 is a block diagram of an example of power distribution to panels.
Figure 7:
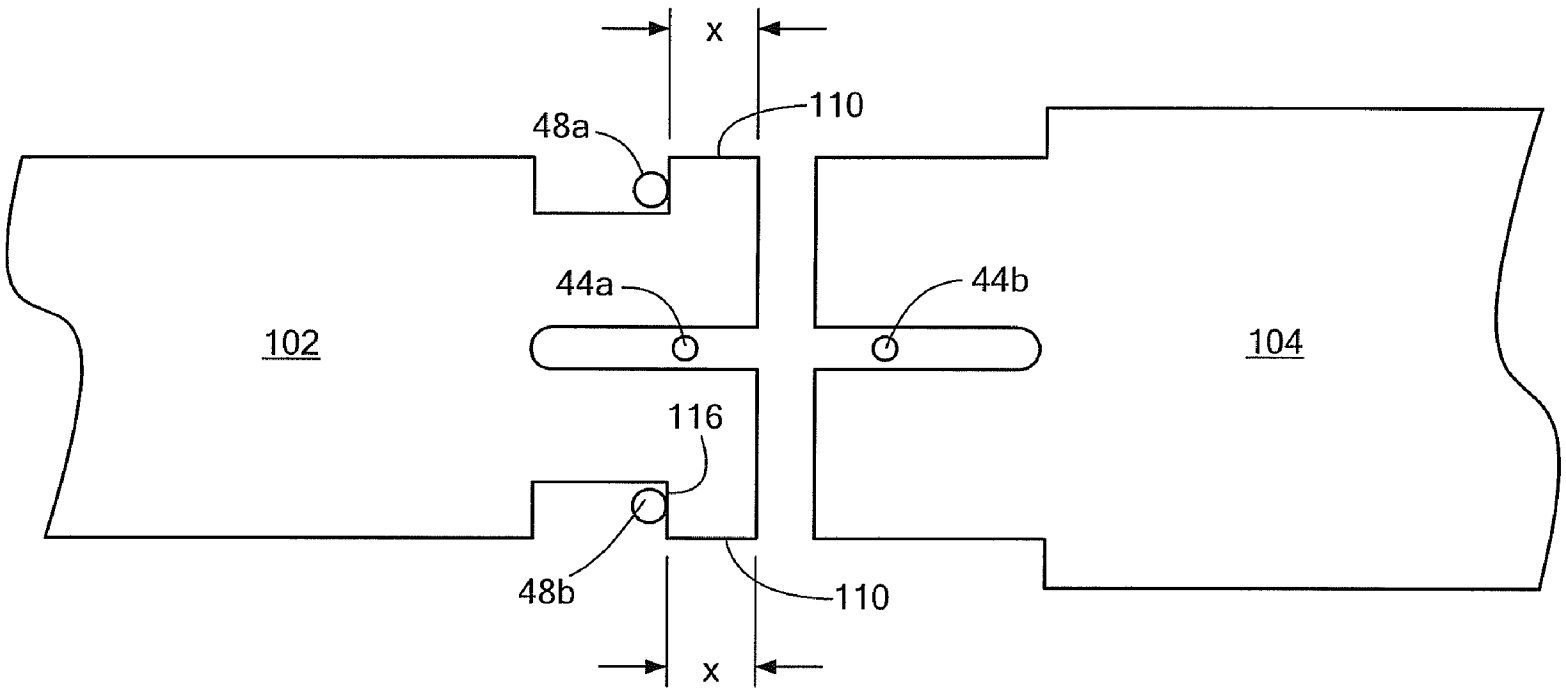
FIG. 7 is a cross-sectional view of the busbar connector with busbars taken along the line 7-7 in FIG. 9B.

Referring to FIG. 4, in one example, four capacitors 26 supplies DC power through the busbar connector 20 to the LRU 14. For example, a busbar 102 (FIG. 7) of the LRU 14 is connected to the busbar 104 (FIG. 7) of the main distribution bus 16. The LRU 14 includes a DC power distribution and logic circuit 32 that provides the DC power, in one particular example, to four power storage and control circuits 34 and each storage and control circuit 34 provides power to two panels 12, for example. The storage and control circuits 34 control the amount of power provided to the panels 12 based on overall system requirements of the panel array system 10.

Figure 5:
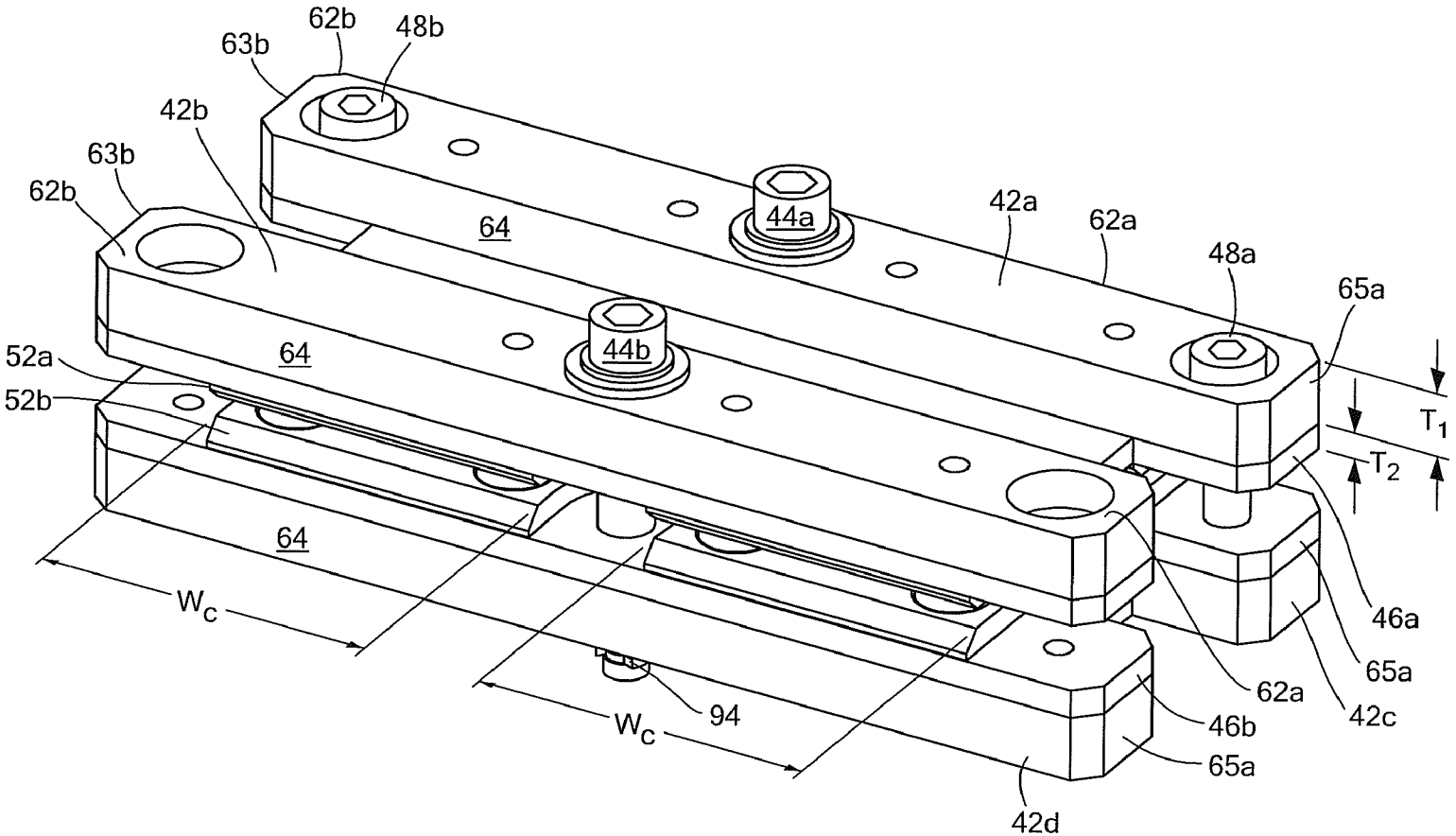
FIG. 5 is a view of the busbar connector.
Figure 6:
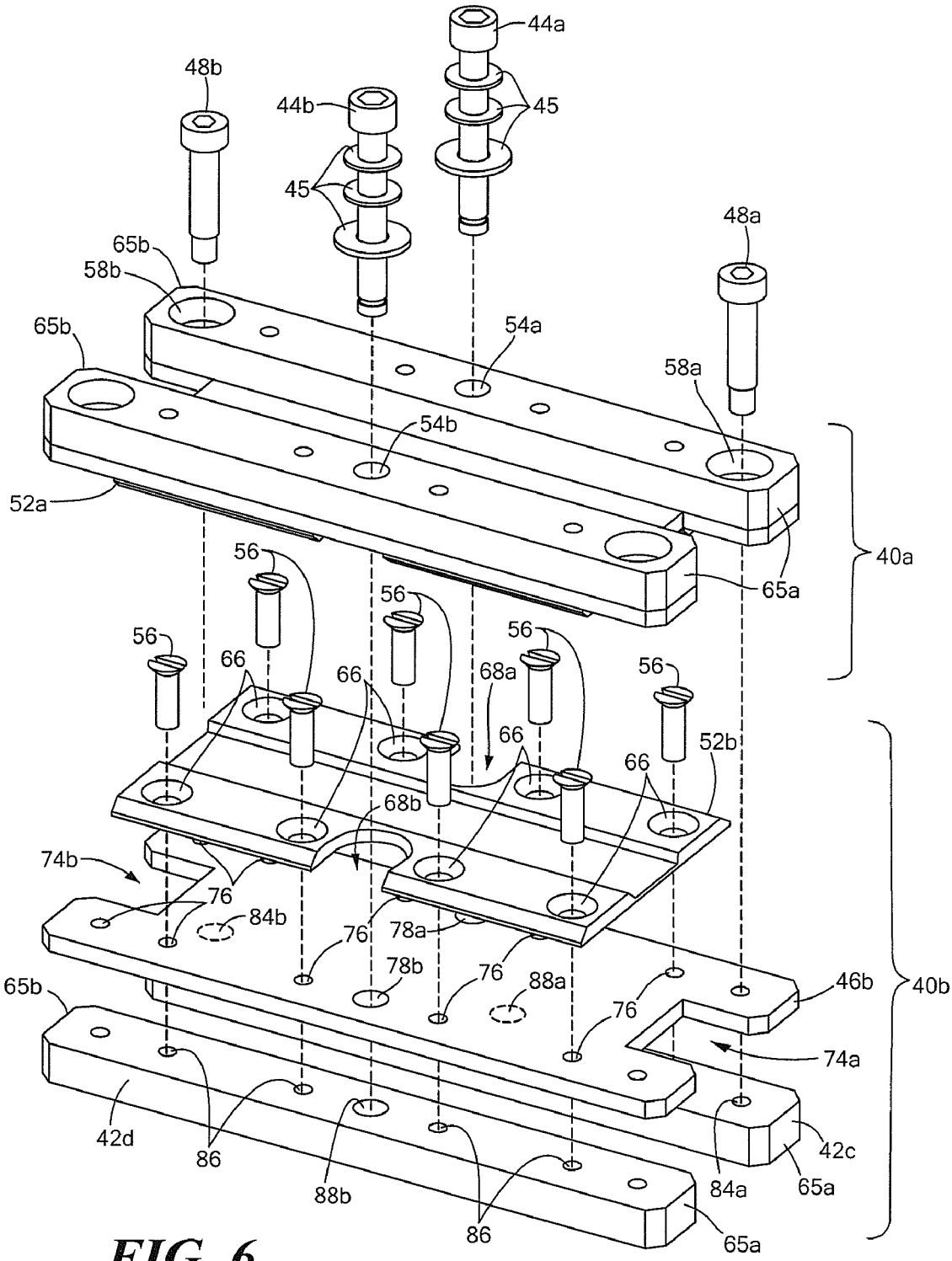
FIG. 6 is an exploded view of the busbar connector of FIG. 5.

FIGS. 5 and 6, the busbar connector 20 includes two portions (e.g., a first portion 40*a* and a second portion 40*b*). Each portion 40*a*, 40*b* includes rigid members, a conductor member and a compliant member. For example, the first portion 40*a* includes rigid members 42*a*, 42*b*, a conductor member 52*a* and a compliant member 46*a* and the second portion 40*b* includes rigid members 42*c*, 42*d*, a conductor member 52*b* and a compliant member 46*b*. The rigid members 42*a*-42*d* includes end portions 62*a*, 62*b* and a center portion 64. The rigid members 42*a*-42*d* also include ends 65*a*, 65*b*. In one example, the rigid member 42*a*-42*d* include a metal (e.g., stainless steel), the compliant members 46*a*, 46*b* are rubber (e.g., having a hardness of 70 durometers) and the conductor members 52*a*, 52*b* are gold-plated copper. In one example, a thickness, $T_1$, of each rigid member 42*a*-42*d* is about 8 mm and a thickness, $T_2$, of each of the compliant members 46*a*, 46*b* is about 3 mm.

The two portions 40*a*, 40*b* are attached together by screws 48*a*, 48*b* (e.g., shoulder screws) extending through the end portions 62*a*, 62*b* of the rigid members 42*a*, 42*c* and screws 44*a*, 44*b* (e.g., clamping screws) extending through center portions 64 of the rigid members 42*a*, 42*c* so that the rigid members 42*a*-42*d* form exterior (or outer) portions of the busbar connector 20 and the conductor members 52*a*, 52*b* form interior (or inner) portions of the busbar connector.

The conductor members 52*a*, 52*b* may be resized to accommodate current and/or inductance requirements. In one example, the conductor members 52*a*, 52*b* includes a smooth gold-plated copper that allows for multiple cycles of connecting and disconnecting busbars without damage to the busbars or the conductor members themselves.

In one example, the conductor members 52*a*, 52*b* are secured to the compliant members 46*a*, 46*b* and to the rigid members 42*a*-42*d* using screws 56. For example, the screws 56 (e.g., nylon screws) extend through corresponding holes 66 in the conductor member 52*b*, through corresponding holes 76 in the compliant member 46*b* and through corresponding holes 86 (e.g., threaded holes) in the rigid members 42*c*, 42*d*. In other examples, the compliant members 46*a*, 46*b* are bonded to the rigid members 42*a*-42*d* and to the conduction members 52*a*, 52*b* 46*a* using one or more of an adhesive, an epoxy and so forth.

The screws 44*a*, 44*b* extend through washers 45 (e.g., three washers each) and through the first and second portions 40*a*, 40*b*. With respect to the first portion 40*a*, the screws 44*a*, 44*b* extend through corresponding holes 54*a*, 54*b* (e.g., threaded holes) at center portions 64 of the rigid members 42*a*, 42*b*, through corresponding holes (not shown) in the compliant members 46*a*, 46*b* and through corresponding gaps (not shown) in the conductor member 52*a*. In one example, the holes 54*a*, 54*b* are equidistant from the ends 65*a*, 65*b* of the rigid members 42*a*, 42*b*. With respect to the second portion 40*b*, the screws 44*a*, 44*b* extend through corresponding gaps 68*a*, 68*b* in the conductor member 52*b*, through holes 78*a*, 78*b* of the compliant member 46*b* and through corresponding holes 84*a*, 84*b* (e.g., threaded holes) on corresponding center portions 64 of the rigid members 42*c*, 42*d*. In one example, the holes 78*a*, 78*b* are equidistant from the ends 65*a*, 65*b* of the rigid members 42*c*, 42*d*. In other examples, the screws 44*a*, 44*b* may be replaced by other types of fastener structures such as clamps, latches and so forth. Clips 94 (e.g., c-clips, e-clips) are attached to the screws 44*a*, 44*b* to prevent the screws from separating from the busbar connector 20 when the screws 44*a*, 44*b* are loosened, which in turn also prevents the first and second portions 40*a*, 40*b* from completely separating from each other.

The screws 48*a*, 48*b* extend through corresponding holes 58*a*, 58*b* on each end portion 62*a*, 62*b* of the rigid member 42*a* and extend through correspond gaps 74*a*, 74*b* in the compliant members 46*a*, 46*b* and secured to corresponding holes 84*a*, 84*b* (e.g., threaded holes) on corresponding end portions of the rigid member 42*c*. The screws 48*a*, 48*b* are a captive mechanism and are used to prevent a particular busbar (e.g., a busbar 102 (FIG. 7)) from separating from the busbar connector 20. The busbar 102 includes tabs 110 that prevent the busbar 102 from separating from the busbar connector 20 because the tabs cannot bypass the screws 48*a*, 48*b*. A busbar 104 (FIG. 7) that does not include tabs can be freely separated from the busbar connector 20 when the screws 44*a*, 44*b* are loosened (e.g., by sliding out the busbar 104). In one example, the LRUs 14 include the busbar 102 and the busbar connector 20 and the main distribution bus 16 includes the busbar 104. The busbar connector 20 allows for subassemblies (e.g., LRUs 14) to be installed (e.g., sliding in the busbar 104) or uninstalled (e.g., sliding out the busbar 104) independent of other subassemblies enabling shorter repair times as damaged assemblies may be replaced without disturbing the rest of the panel array system 10.

In other examples, the tabs 110 may be used with the screws 48*a*, 48*b* to position the busbar 102 so that both busbars 102, 104 spans the conduction members 52*a*, 52*b* an equal amount of area, for example. In particular, a busbar 102 may be fabricated such that when sides 116 of the tabs 110 are in contact with the screws 48*a*, 48*b*, the busbar 102 extends a distance, X, into the busbar connector 20. Thus, the busbar 102 can be fabricated so that the distance X may be chosen to correspond to the busbar 102 covering a desired amount of a surface area between the conduction members 52*a*, 52*b*. Thus, a user is able to connect the busbar 102 to the busbar 104 quickly.

Figure 8:
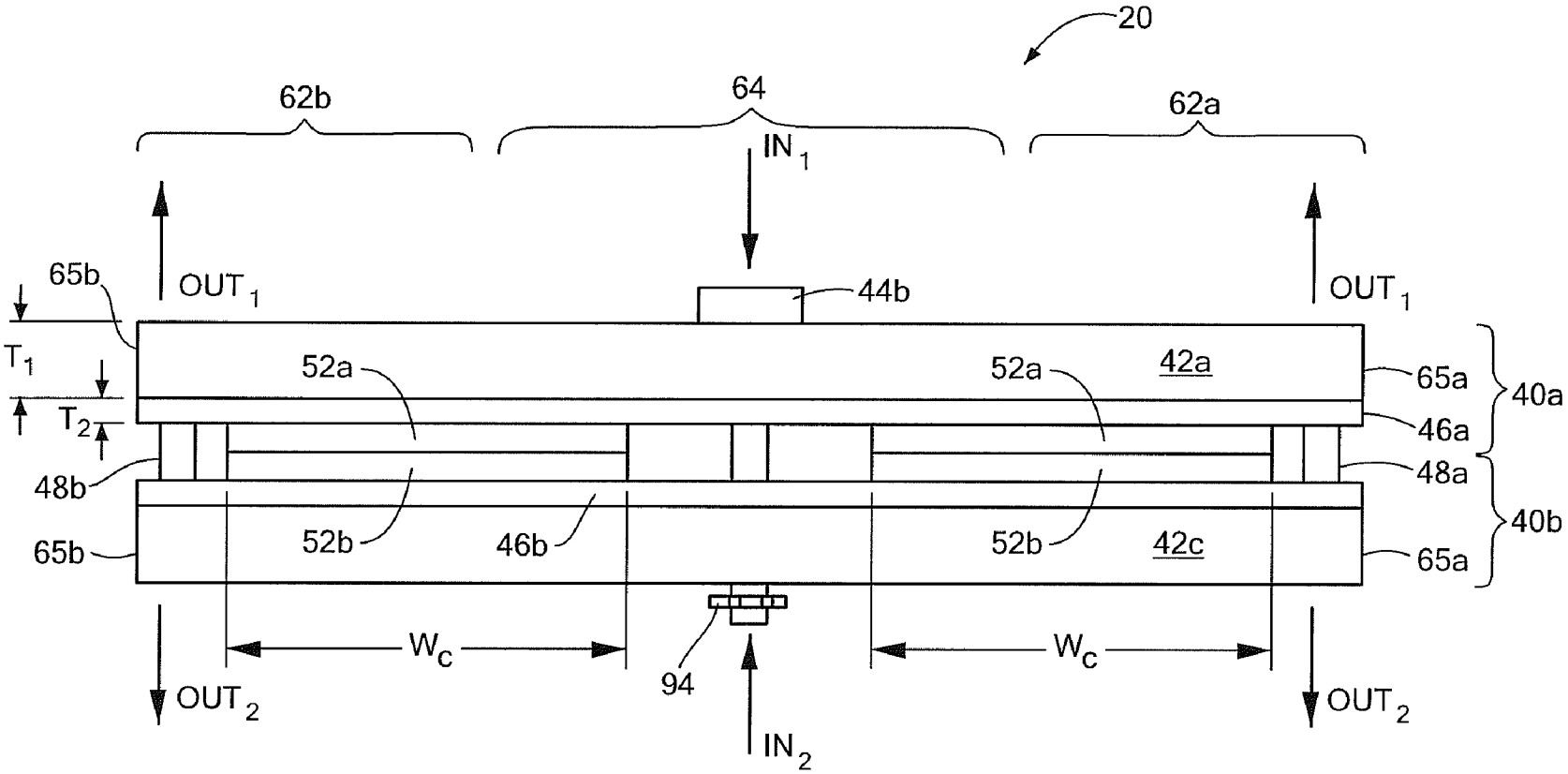
FIG. 8 is a side-view of the busbar connector of FIG. 5.

Referring to FIG. 8, the screws 44*a*, 44*b* are used to fasten the first and second portions 40*a*, 40*b* together to form a secure and tight connection with the busbars 102, 104 by applying a force in a center portion 64 of the rigid members 42*a*, 42*c* in directions $IN_1$, $IN_2$. Not seen with the human eye, the end portions 62*a*, 62*b* bow up and away from the connector 20 in directions, $OUT_1$, $OUT_2$. Without the compliant members 52*a*, 52*b*, this would have an effect of not providing a physical/electrical contact across the entire width of the conductor members 52*a*, 52*b* and the busbar (e.g., between the busbars 102, 104 and the conductor members 52*a*, 52*b* along the widths $W_C$). The effect of this bowing on the electrical connection between the conduction members 52*a*, 52*b* and the busbars 102, 102*b* is minimized by the low stiffness of the compliant members 46*a*, 46*b* (e.g., compared to the rigid members) between the conduction members and the rigid members 42*a*-42*d* thereby resulting in a low inductance connection. Specifically, since the stiffness of the compliant members 52*a*, 52*b* is less than the stiffness of the rigid member 42*a*-42*d*, a physical/electrical contact across the entire width of the conductor portion of the connector and the busbar is achieved (e.g., between the busbars 102, 104 and the conductor members 52*a*, 52*b*, along the widths $W_C$). In one example, the inductance is less than 2 nH. In one example, when screws are tightened, the pressure along the widths $W_C$ is consistently greater than 10 psi. In one example, the screws 44*a*, 44*b* are 300 series stainless steel #10-32 and the screws are tightened to the recommended torque for such screws (e.g., about 17 in-lbs)

Figure 9A:
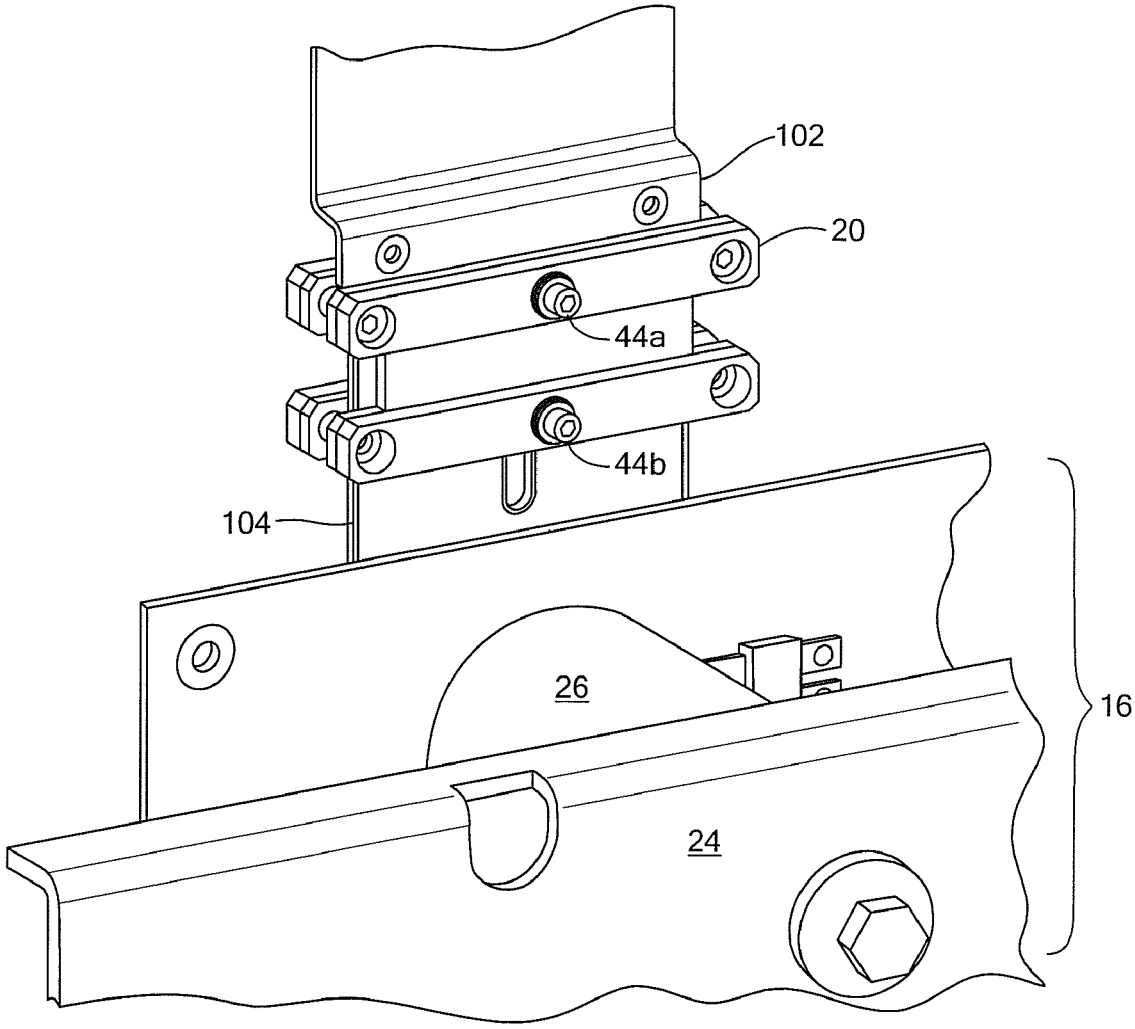
FIG. 9A is a view of the busbar connector disengaged from the busbars.
Figure 9B:
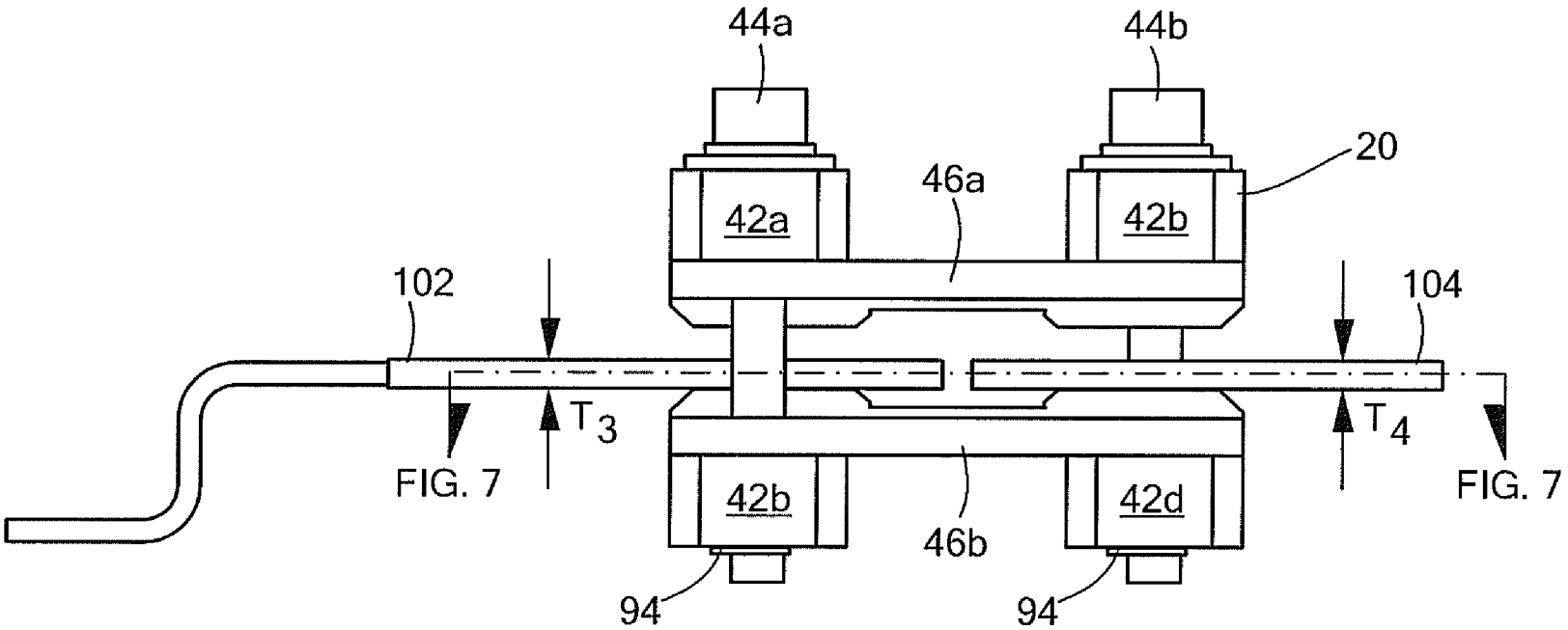
FIG. 9B is a side-view of the busbar connector disengaged from the busbars.
Figure 10A:
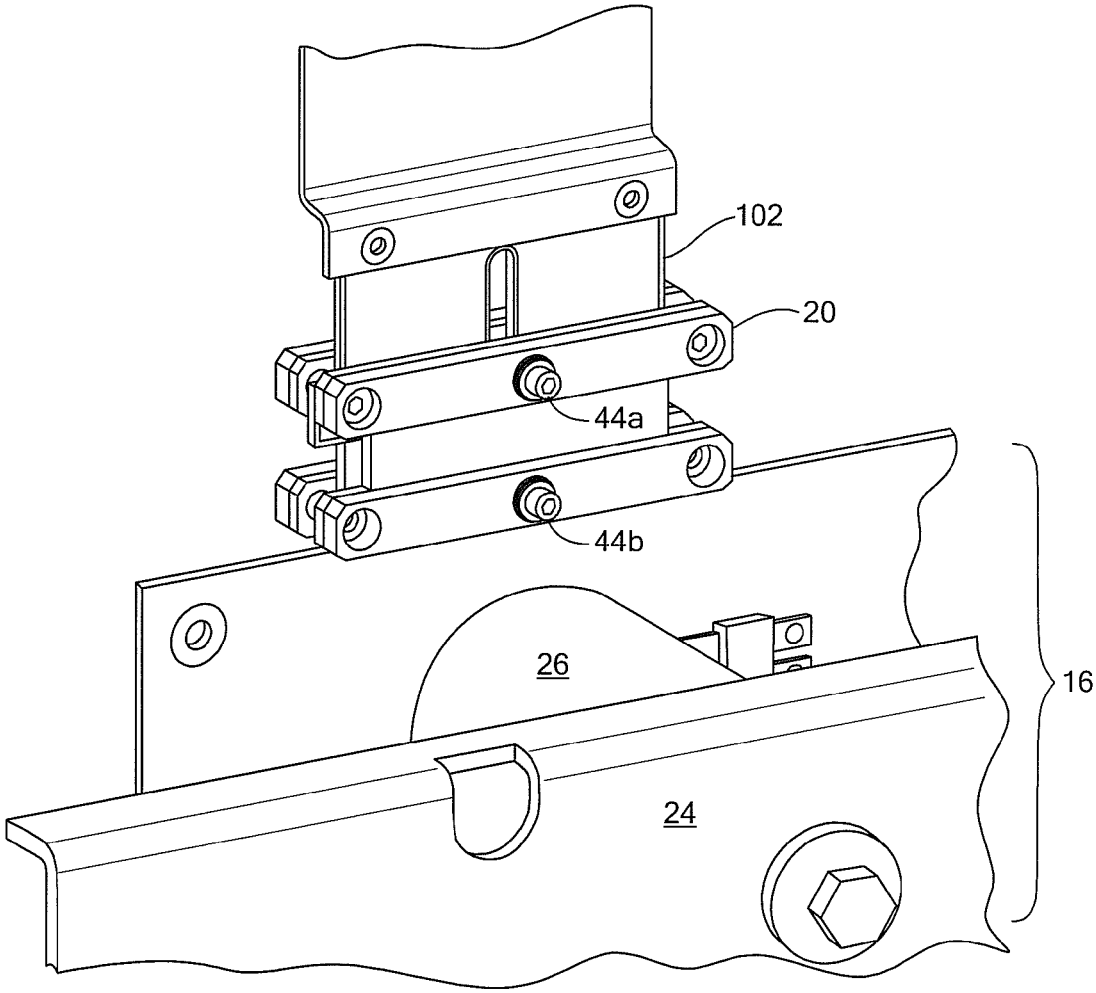
FIG. 10A is a view of the busbar connector engaged with the busbars.
Figure 10B:
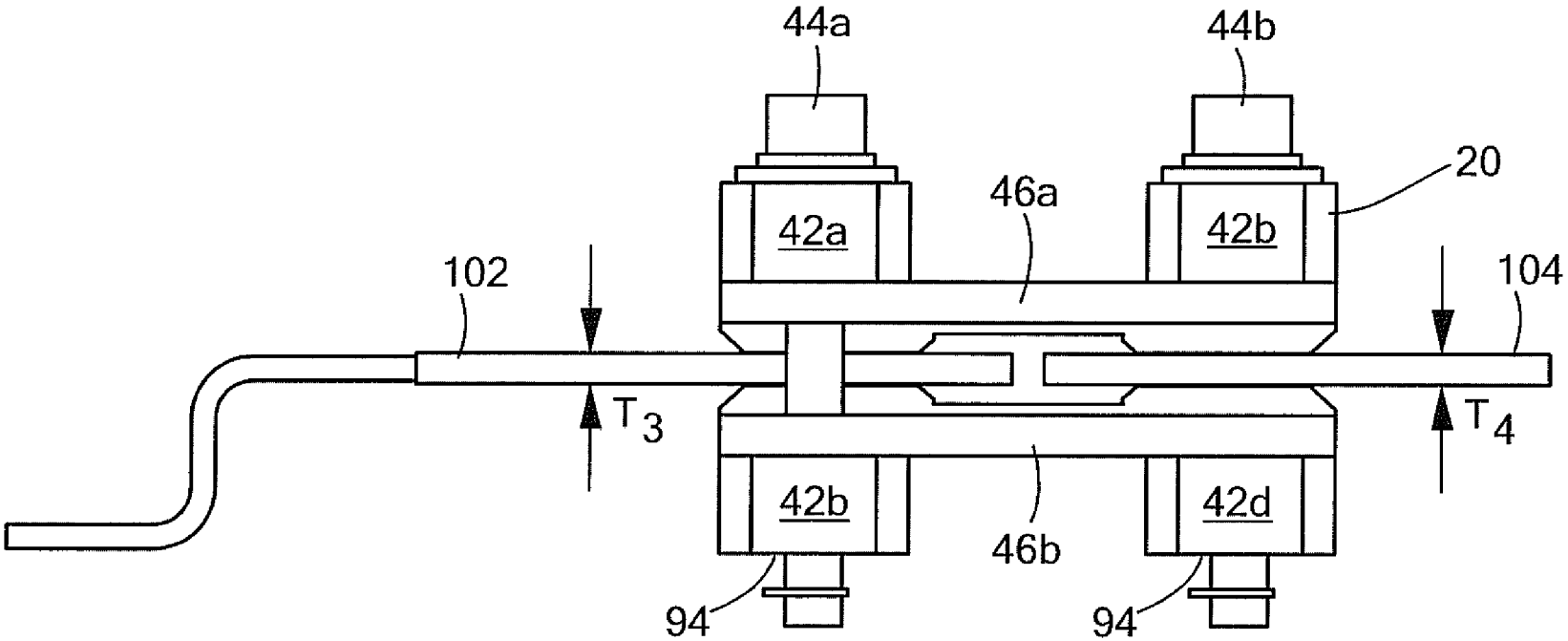
FIG. 10B is a side-view of the busbar connector engaged with the busbars.

Referring to FIGS. 9A, 9B, 10A and 10B, the connection or disconnection of the busbars 102, 104 is performed by inserting or removing the busbars using little or zero force and by tightening or loosening of the screws 44*a*, 44*b*. For example, when the screws 44*a*, 44*b* are loosened the busbar connector 20 is disengaged from the busbar 104 and the busbar 104 may be removed (FIGS. 8A and 8B). In another example, the busbars 102, 104 are inserted into the busbar connector 20. When the screws 44*a*, 44*b* are tightened the busbar connector 20 is engaged to the busbars 102, 104 to provide an electrical connection to allow current flow between the busbars 102, 104 (FIGS. 9A and 9B). The location of the screws 44*a*, 44*b* in the central portion 64 of the rigid members 42*a*, 42*c* allows for repeatable results without a need for a specialized torque sequence between the screws 44*a*, 44*b*.

The busbar connector 20 can also adapt to different busbar thicknesses. For example, if the busbar 102 has a thickness $T_3$ and the busbar 104 has a thickness $T_4$, the busbar connector 20 can accommodate $T_3>T_4$, $T_3=T_4$ and $T_3<T_4$. The busbar connector 20 can also compensate for a misalignment and/or a non-coplanarity between the busbars 102, 104 due to assembly and manufacturing tolerances.

In other examples, the rigid members 42*a*, 42*b* are replaced with a single rigid member and the rigid members 42*c*, 42*d* are replaced by another single member. In this configuration the ability of the busbar connector 20 to absorb any angular and/or thickness differences that may exist between the two busbars is limited; however, this configuration may be desirable if the busbars 102, 104 are required to conform rather than the busbar connector 20.

Elements of different embodiments described herein may be combined to form other embodiments not specifically set forth above. Other embodiments not specifically described herein are also within the scope of the following claims.

What is claimed is:

1. A busbar connector comprising:

first and second portions, each portion comprising:

a rigid member forming an exterior portion of the busbar connector;

a conduction member forming an interior portion of the busbar connector; and a compliant member having a stiffness less than the rigid member and comprising a first surface attached to the rigid member and a second surface opposite the first surface attached to the conduction member; and a fastener structure configured to secure a first busbar and a second busbar between and in contact with the conduction members of the first and second portions to allow current to flow between the first and second busbars.

2. The busbar connector of claim 1 wherein the fastener structure is configured to secure the first busbar and the second busbar by applying an inward force from the exterior portion of the busbar connector to the interior portion of the busbar connector substantially in the center of the rigid members.

3. The busbar connector of claim 1 wherein the fastener structure comprises a screw that extends through the rigid member of the first portion and the rigid member of the second portion.

4. The busbar connector of claim 1, further comprising a first shoulder screw and a second shoulder screw connecting the first and second portions;

wherein the first busbar comprises tabs captivated by the shoulder screws.

5. The busbar connector of claim 1 wherein the rigid member is a first rigid member, and each of the first and second portions further comprising a second rigid member forming an exterior portion of the bus.

6. The busbar connector of claim 1 wherein the rigid member comprises a metal.

7. The busbar connector of claim 1 wherein the compliant member comprises rubber.

8. The busbar connector of claim 1 wherein the compliant member has a hardness of 70 durometers.

9. The busbar connector of claim 1 wherein the conduction member comprises copper.

10. The busbar connector of claim 1 wherein the conduction member comprises gold-plated copper.

11. The busbar connector of claim 1, further comprising a first set of nylon screws coupling the rigid member, the compliant member and the conductor member.

12. The busbar connector of claim 1, wherein the compliant member is coupled to the rigid member and the conduction member using at least one of an adhesive and an epoxy.

13. The busbar connector of claim 1, wherein the first busbar and the second busbar have different thicknesses.

14. A busbar connector comprising:

first and second portions, each portion comprising:

first and second rigid members forming an exterior portion of the busbar connector;

a conduction member forming an interior portion of the busbar connector; and a compliant member having a stiffness less than the first and a second rigid members and comprising a first surface attached to the first and a second rigid members and a second surface opposite the first surface attached to the conduction member; and a first fastener structure and a second fastener structure configured to secure a first busbar and a second busbar between and in contact with the conduction members of the first and second portions to allow current to flow between the first and second busbars by applying a force from the exterior portion of the busbar connector to the interior portion of the busbar connector on each of the first and second rigid members substantially in center portions of the first and a second rigid members.

15. The busbar connector of claim 14 wherein the fastener structures comprise screws.

16. The busbar connector of claim 14 wherein the first and second rigid members comprise a metal, the compliant member comprises rubber and the conduction member comprises gold-plated copper.

17. The busbar connector of claim 14, further comprising a first shoulder screw and a second shoulder screw extending through corresponding holes in the first rigid member of the first portion and secured to corresponding threads in the first rigid member of the second portion, wherein the first busbar comprises tabs captivated by the first and second shoulder screws.

18. The busbar connector of claim 14, wherein the first busbar and the second busbar have different thicknesses.

* * * * *

UNITED STATES PATENT AND TRADEMARK OFFICE

CERTIFICATE OF CORRECTION

PATENT NO. : 7,704,083 B1
APPLICATION NO. : 12/409639
DATED : April 27, 2010
INVENTOR(S) : Cheyne et al.

It is certified that error appears in the above-identified patent and that said Letters Patent is hereby corrected as shown below:

Col. 1, line 47, delete "in centers of the" and replace with --in center portions of the--.

Col. 2, line 2-3, delete "and a second" and replace with --and second--.

Col. 2, line 20, delete "of diagram" and replace with --of a diagram--.

Col. 2, line 65, delete "LRU 14." and replace with --LRUs 14.--.

Col. 4, line 6, delete "member" and replace with --members--.

Col. 4, line 36, delete ", 52b 46a using" and replace with --, 52b using--.

Col. 4, line 51, delete "84a, 84b" and replace with --88a, 88b--.

Col. 4, line 53, delete "78a, 78b" and replace with --88a, 88b--.

Col. 5, line 19, delete "spans" and replace with --span--.

Col. 5, line 36, delete "52a, 52b," and replace with --46a, 46b,--.

Col. 5, line 42, delete "102, 102b" and replace with --102, 104--.

Col. 5, line 47, delete "52a, 52b" and replace with --46a, 46b--.

Col. 5, line 47-48, delete "member" and replace with --members--.

Col. 5, line 64, delete "(FIGS. 8A and 8B)." and replace with --(FIGS. 9A and 9B).--.

Col. 6, line 2, delete "(FIGS. 9A and 9B)." and replace with --(FIGS. 10A and 10B).--.

Col. 6, line 59, delete "bus." and replace with --busbar connector.--.

Signed and Sealed this

Fifteenth Day of June, 2010

David J. Kappos

David J. Kappos
*Director of the United States Patent and Trademark Office*